US008495771B1

(12) United States Patent
Damman

(10) Patent No.: US 8,495,771 B1
(45) Date of Patent: Jul. 30, 2013

(54) POTTY SEAT WITH SANITARY REMOVABLE BOWL AND BACKREST HANDLE

(75) Inventor: Kathleen Damman, Summit, NJ (US)

(73) Assignee: K.B. Products Corporation, Huntington, NY (US)

( * ) Notice: Subject to any disclaimer, the term of this patent is extended or adjusted under 35 U.S.C. 154(b) by 0 days.

(21) Appl. No.: 13/453,087

(22) Filed: Apr. 23, 2012

(51) Int. Cl.
*A47K 11/04* (2006.01)

(52) U.S. Cl.
USPC ..... 4/483; 4/902; 4/905; 4/479

(58) Field of Classification Search
USPC ..... 401/483, 484, 479, 902, 905, 462, 401/239, 420.3, 445, 661
See application file for complete search history.

(56) References Cited

U.S. PATENT DOCUMENTS

| | | | | |
|---|---|---|---|---|
| 2,050,114 | A * | 8/1936 | Moore | 4/483 |
| 2,602,166 | A | 7/1952 | Aitken | |
| 2,719,305 | A | 10/1955 | La Hue | |
| 3,137,010 | A | 6/1964 | Ross | |
| 5,363,516 | A * | 11/1994 | Butts | 4/661 |
| 5,978,976 | A * | 11/1999 | Chai | 4/483 |
| 6,523,187 | B1 | 2/2003 | Brink et al. | |
| 6,698,036 | B2 * | 3/2004 | Armbruster et al. | 4/483 |
| 7,461,411 | B2 * | 12/2008 | Wolf | 4/239 |
| 7,779,489 | B2 | 8/2010 | Finell | |
| 7,891,030 | B1 * | 2/2011 | Sutton | 4/483 |
| 8,079,097 | B2 | 12/2011 | Deutsch | |
| 2008/0083061 | A1 | 4/2008 | Dubiel | |
| 2008/0263756 | A1 * | 10/2008 | Marsden | 4/239 |
| 2011/0030134 | A1 | 2/2011 | Dubiel | |
| 2012/0084908 | A1 * | 4/2012 | Dunn et al. | 4/483 |
| 2012/0084909 | A1 * | 4/2012 | Dunn et al. | 4/483 |

* cited by examiner

*Primary Examiner* — David Walczak
*Assistant Examiner* — Jennifer C Chiang
(74) *Attorney, Agent, or Firm* — Dentons US LLP

(57) ABSTRACT

The present invention relates to a child's potty seat that utilizes a combination waste collection bowl with an integral backrest and handle to isolate the handle away from the bowl contaminated with bodily wastes. The potty seat is made up of a seat portion and a removable bowl portion that is sanitary easy to clean and can be used as a handle.

15 Claims, 3 Drawing Sheets

Fig. 1
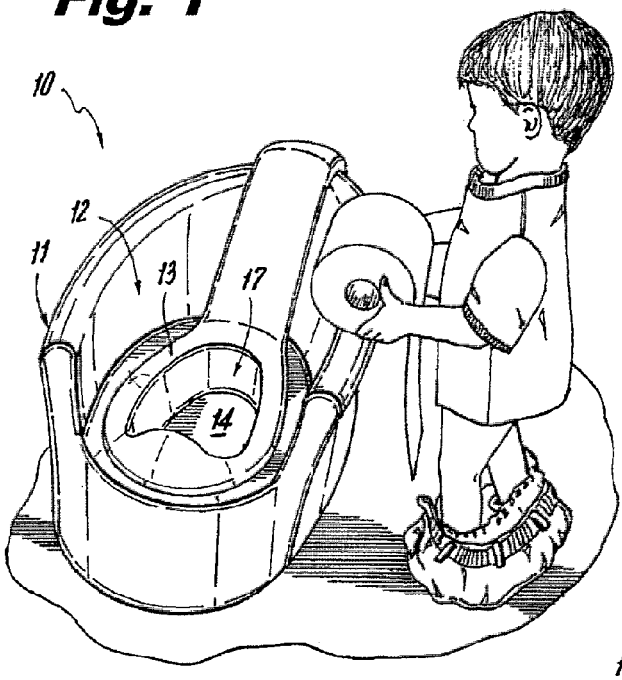
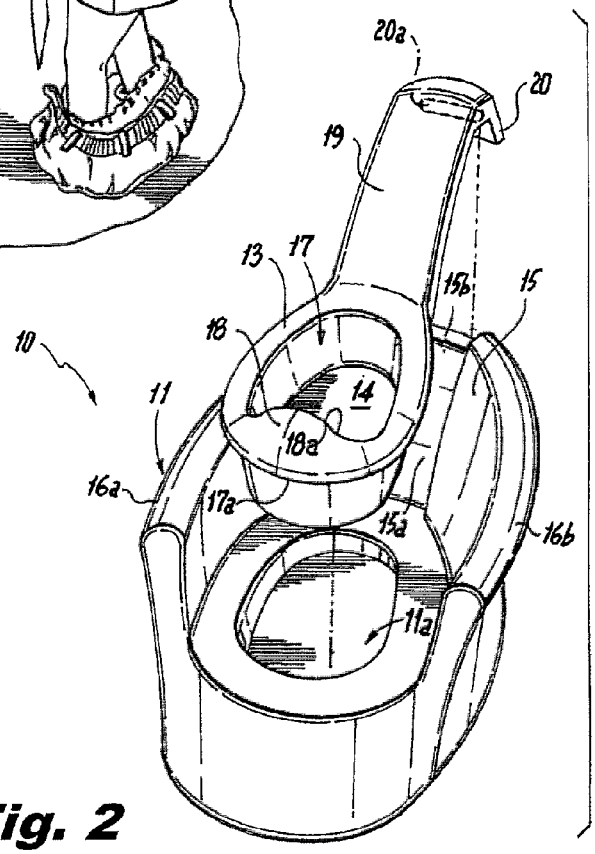
Fig. 2

POTTY SEAT WITH SANITARY REMOVABLE BOWL AND BACKREST HANDLE

FIELD OF THE INVENTION

The present invention relates to a child's potty seat. More specifically, it relates to a potty seat with a removable bowl with an integrated backrest/handle.

BACKGROUND OF THE INVENTION

Children's potty chairs have been in existence since ancient times. With the advent of modern plastic and plastic-forming equipment, it is now possible to produce a potty chair that is more comfortable for the user and easier for the caregiver to sanitize and clean.

Some traditional potty seats may include a removable bowl with a handle in the front that allows a care giver to remove the bowl after use. However, the handle is located in the vicinity of the front of the bowl near an area that may be unsanitary. For example, U.S. Pat. No. 3,137,010 to Ross discloses removable bowl with a handle located in the front of the bowl. Similarly, U.S. Pat. No. 7,779,489 to Finell discloses a removable bowl with a handle in the front. This is also true of bowls that contain urine deflector areas which are used to contain a urine stream. Additionally, a bowl may be contaminated with solid and liquid wastes from toddlers of either sex. Placement of the handles or grasping surface in the general vicinity of the bowl, especially in the front of the bowl, exposes the caregiver to human waste which is not suitable for preventing the spreading of germs onto the hands of the caregiver.

Additionally, potty chairs need to conserve space while at the same time be large enough to comfortably support a child. They need to be safe and user and child-friendly as well as having design appeal. Accordingly, a need exists for a potty seat with a removable bowl that is easy to clean and allows the caregiver to empty and clean the bowl in a sanitary manner without contacting the waste. Furthermore, a need exists for a potty seats that better contains waste within the bowl unit, better facilitates a child's sitting down and standing up, makes for easier disposal and clean up for the caregiver, and that prevents the bowl unit from lifting up when the user stands up.

SUMMARY

It is therefore an object of the present invention to provide a potty seat with a sanitary removable bowl for cleaning purposes, which isolates the hand of the caregiver away from the bowl.

It is also an object of the present invention to provide an ergonomically comfortable potty seat for the toddler user that prevents lift up of the seat when in use. It is also an object of the present invention to deflect male urine streams downward.

The benefits of the potty seat of the present invention includes providing for easier disposal; proving for easier cleaning; more ergonomic and comfortable design that accommodates different body types; better waste containment; and better bowl retention.

A potty seat of the present disclosure comprises a base chair having an open seat portion, a first backrest portion having a pair of oppositely located armrests extending forward therefrom, and a rim portion. The potty seat also comprises a removable bowl comprising a bowl portion and a backrest/handle portion that extends upward from the bowl portion. The backrest or handle portion is located adjacent to a mid section region of the first backrest portion of the base chair when the removable bowl is in the open seat portion and the removable bowl is supported by the rim portion.

The backrest/handle portion of the removable bowl may interlock with the base chair and secures the removable bowl so that it does not dislocate when the child stands up. The open seat portion of the base chair may also comprise a forward sloping open seat portion. Additionally, the backrest/handle portion of the removable bowl fits flush within a cutout or recess in the first backrest portion of the base chair when the removable bowl is supported by the rim portion.

The removable bowl may be elliptical and it may comprise a urine deflector. Additionally, the urine deflector may be integrated into a portion of the removable bowl and it may be located approximately opposite the handle portion. The removable bowl may have a forward sloping bottom 13*a* and the base chair may comprising a non slip bottom.

The backrest or handle portion of the removable bowl may contain a handle cut out or hand hold that may be used for a transport handle. The forward sloping open seat portion of the base chair allows the user's waste to collect in the front of the removable bowl when the removable bowl is supported by the rim portion. The potty seat may also comprise a urine deflector, and a forward sloping open seat portion of the base chair that causes the user's urine stream to be diverted downwardly into the front of the removable bowl when the removable bowl is supported by the rim portion. The removable bowl may be ladle shaped and may allow a user to remove the removable bowl and dispose of the waste without contacting the waste.

In an embodiment, the bottom of the bowl may slanted to allow for easier disposal of waste. In an embodiment, the bottom of the bowl is slanted at an angle away from the back to allow for easier disposal. The top of the bowl when placed over the seat may also be slanted downward to deflect urine downward towards the deflector.

The bowl may be round or have a wide ellipse shape that allows for ease of cleaning without contacting the insides of the bowl. In an embodiment, the backrest/handle of the bowl has a dipper hook-up shape extending from bowl and adjacent to the backrest going over the top of the back of the chair and hooking into a recess cut out in the backrest, which prevents the bowl from lifting when the child stands up.

The bowl may also have a deflector molded into the shape to deflect urine. Alternatively, the deflector may be a separate piece which interlocks with the bowl when required. Placement and the size of deflector allows a child to move easily back onto chair. Placement and size of the urine deflector also provides more clearance when a child sits down and gets up. In an embodiment, the chair has forward extending armrests that provides support and stability when the child sits and stands up.

Additionally, in an embodiment, the forward slant of chair unit allows for a smaller deflector size because it positions the user's penis in a downward direction. In combination with the deflector, the inside front of the bowl unit maybe concave in shape and comprise a rounded indented area for better containment of urine.

The potty chair may be a simple two piece construction that includes a seat and a bowl with a backrest/handle. Additionally, it may be composed of any number of components assembled by various methods to arrive at the present configuration. The color and design of the potty chair should be of such quality as to blend with any design appeal of the purchaser.

BRIEF DESCRIPTION OF THE DRAWINGS

The present invention can best be understood in connection with the accompanying drawings. It is noted that the invention is not limited to the precise embodiments shown in drawings, in which:

FIG. 1 is a perspective view of an embodiment of the potty seat of the present disclosure with a sanitary removable bowl for cleaning purposes of the present invention;

FIG. 2 is a side view of an embodiment of the bowl and backrest handle portion of the present disclosure, where the dotted line and downward facing arrows indicates a downward sloping of the bowl when positioned for use in the potty seat of FIG. 1;

DETAILED DESCRIPTION OF THE INVENTION

Figure 3:
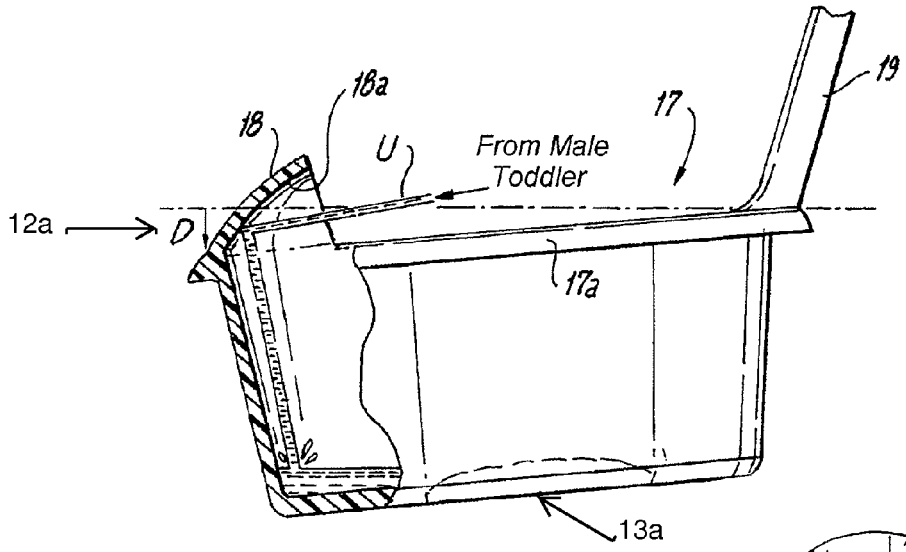
FIG. 3 is a top plan view of an embodiment of the bowl and backrest handle portion of FIG. 2.
Figure 4:
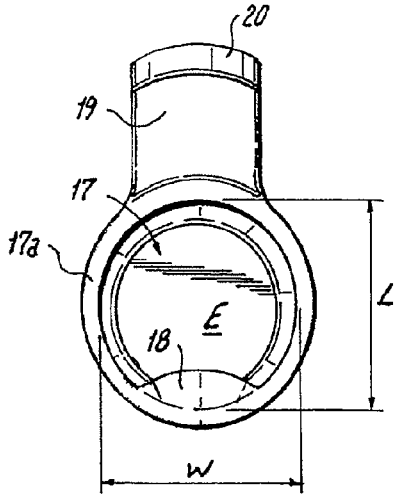
FIG. 4 is a front elevation view of an embodiment of the bowl and backrest handle portion of FIG. 2.
Figure 5:
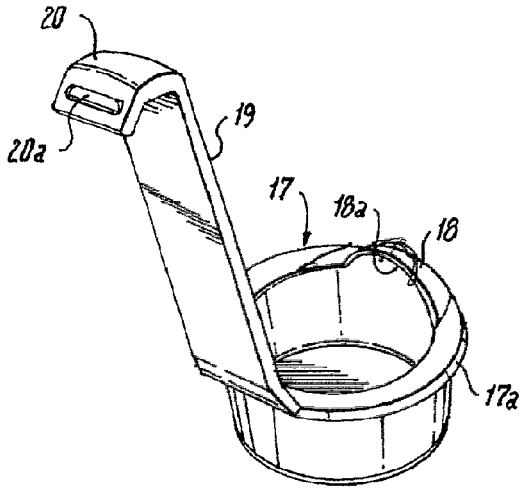
FIG. 5 is a front elevation view of an embodiment of the potty seat of FIG. 1, where the lower dashed lines indicates a cutaway view showing the downwardly sloping bowl within the potty seat and the top dashed line indicates the wrapping of the backrest handle over the top edge of the backrest of the potty seat.
Figure 6:
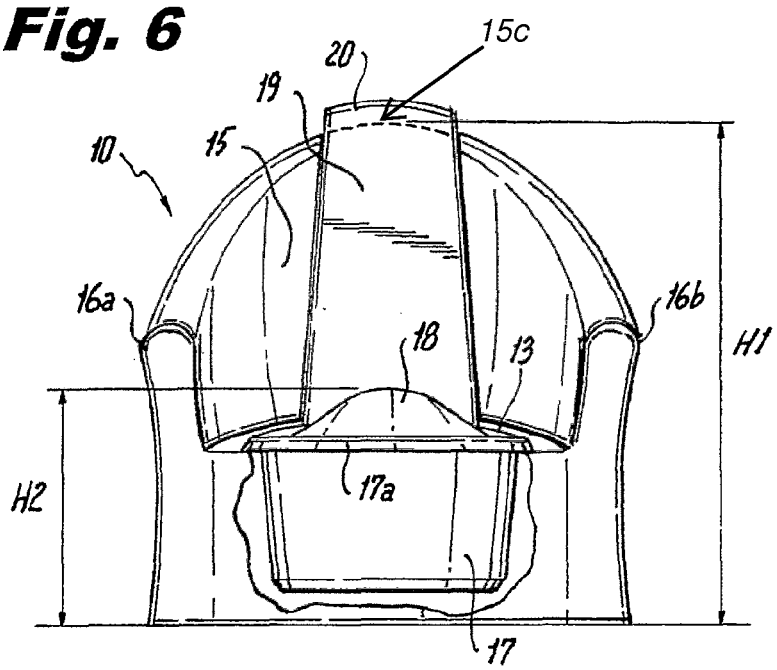
FIG. 6 is a side elevation view of an embodiment of the potty seat of FIG. 1, where the exterior armrests and chair portion of the potty seat are shown in dashed lines, and wherein the arrow and dashed line combination indicates the downwardly sloping bowl within the potty seat.

For illustrative purposes only, an embodiment for carrying out the invention is described herein, wherein a potty seat utilizes a combination bowl with a backrest/handle to isolate the care giver's hand away from the bowl contaminated with bodily wastes.

FIGS. 1-7 depict an embodiment of a potty seat 10 with a removable bowl 17. Potty seat 10 includes a base chair 11, having an open seat portion 12 with an oval annular ring shaped seat 13 and open recess 14.

Base chair 11 has a first backrest portion 15 with a pair of oppositely located armrests 16*a* and 16*b* extending forward from the backrest portion 15. The armrests may be smooth or contoured to aid with positioning of the user and to assist with ease of sitting and standing when the seat is in use. Additionally, the armrests 16*a-b* may be shaped to resemble a club chair or any other desired design style.

Removable bowl 17 may have a urine deflector 18 molded into the front edge for capture of a forward moving stream of urine. Alternatively, urine deflector 18 may be separate and removable from removable bowl 17. In a removable configuration, it may be connected by any known means such as tabs, inserts, clips, etc. Preferably, deflector 18 has a concave indented region 18*a* for deflection and capture of the urine stream. Region 18*a* maybe shaped to deflect the urine stream downwardly into removable bowl 17.

Removable bowl 17 maybe supported within the opening 14 of base chair 11, underneath the open oval annular ring shaped seat portion 13 by peripheral lip 17*a* which may extend over an edge of the open seat portion 13. In an embodiment, bowl 17 and oval annular ring shaped seat portion 13 are molded from a single piece. Removable bowl 17 has a backrest portion 19 that extends upward from, and is contiguous with bowl 17. Backrest portion 19 may be adjacent to a mid section region 15*c* of a first backrest portion 15 of base chair 11. Backrest portion 19 preferably fits within a cutout recess or indent 15*a* within first backrest portion 15 of base chair 11. In this manner, bowl 17 is secured into the base chair 11 and prevents backrest portion 19 from accidentally being pulled upward when the user stands up from chair 10. Further, the insertion of backrest portion or handle 19 into cutout recess or indent 15*a* within backrest portion 15 presents the user with a flush or level surface upon which to rest.

Backrest portion 19 extends up from bowl 17 and may have a hand hold 20 at the distal end thereof, opposite to where backrest portion 19 joins bowl 17. This placement of the hand hold 20 at the distal end of backrest portion 19 isolates hand hold 20 from any waste within removable bowl 17 and eliminates or minimizes contact between any bodily waste collected on the bowl 17 and urine deflector 18 and the cleaner.

Hand hold 20 can be of any graspable configuration, in an embodiment, the hand hold 20 wraps around and hooks over an upper edge 15*b* of the primary first backrest portion 15 of the base chair 10. To facilitate manual grasping, hand hold 20 may have an oval hole 20*a* or other shapes to ease insertion and removal of bowl 17 from base chair 11. Hole 20*a* for hand hold 20 is preferably positioned about 2 inches down from the top, with a width of about 3½ inches, although other configurations are possible.

Figure 7:
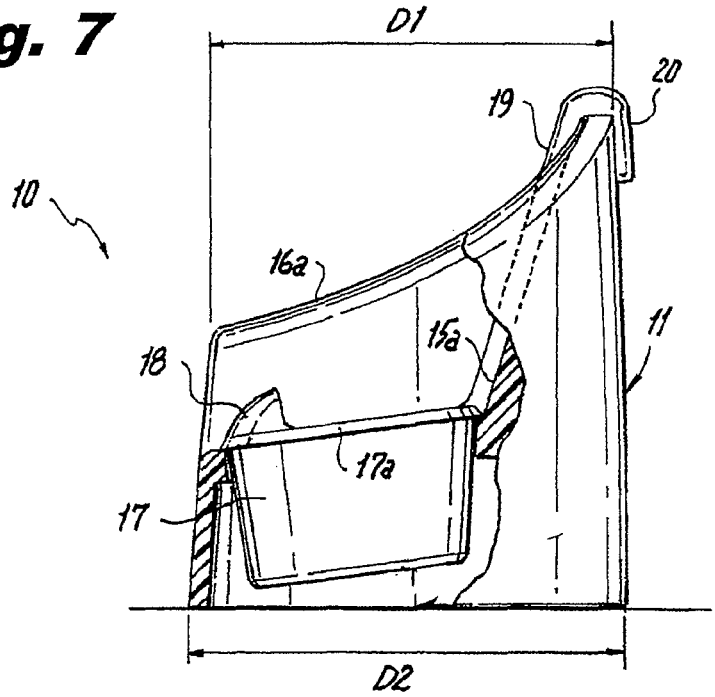
FIG. 7 is a further perspective view of an embodiment of the potty seat as in FIG. 1 showing the combination bowl/backrest and handle portions.

In an embodiment, as seen in FIGS. 3 and 7, open seat portion 12 of the base chair 11 is oriented downward towards the front of base chair 11, as indicated by the arrow "D" (12*a*) and dashed horizontal line of FIG. 3, to orient a male child's urine downward towards concave portion 18*a* of the urine deflector 18. As seen in FIG. 3, bowl 17 may be shaped to allow oval 13 and bowl 17 seated within space 14 to slope away from back 15 to be more ergonomic as well as keep any waste as forward as possible within bowl 17.

To further minimize contamination of removable bowl 17 may have a wide elliptical shape to provide a region for the caregiver's cleaning the bowl 17 manually with wipes or other cleaning materials, without the user's skin contacting a contaminated surface of the bowl 17. In an embodiment, removable bowl 17 has a front to back dimension of about 7¼ inches and a side to side dimension of about 6½ inches. Lip 17*a* of bowl 17 extends outward about one inch from the top edge of the bowl 17. In an embodiment, the base chair 11 is about 15 to 17 inches in height from top to bottom in the rear and about 6 inches in height at the front portion where the urine deflector 18 meets the front of the base chair 11. Backrest portion 19 may be about 7 to 7½ inches wide and the backrest opening may be about 10½ inches wide. In an embodiment, arm rests 16*a* and 16*b* are preferably about 6½ inches forward from backrest 15. The width of armrests 16*a* and 16*b* may be about 1½ inches wide. The forward portions of armrests 16*a* and 16*b* may rise up about ¾ inches or more off of horizontal, to enable the user to better grasp each armrest when standing up from the base chair 11. In an embodiment, front to back top outside depth may be about 10½ inches and the bottom depth at the base may be about 11½ inches.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

The invention claimed is:

1. A potty seat comprising:

a base chair having an open seat portion, a first backrest portion having a pair of oppositely located armrests extending forward therefrom, and a rim portion; and a removable bowl, wherein the removable bowl comprises a bowl portion and a handle portion extending upward from the bowl portion, and wherein the handle portion is adjacent to a mid section region of the first backrest portion when the removable bowl is in the open seat portion; and wherein the removable bowl is supported by the rim portion.

2. The potty seat of claim 1 wherein the handle portion of the removable bowl interlocks with the base chair and secures the removable bowl.

3. The potty seat of claim 1 wherein the open seat portion of the base chair comprises a forward sloping open seat portion.

4. The potty seat of claim 1 wherein the handle portion fits flush within a cutout recess in the first backrest portion when the removable bowl is supported by the rim portion.

5. The potty seat of claim 1 wherein the removable bowl is elliptical.

6. The potty seat of claim 1 further comprising a urine deflector.

7. The potty seat of claim 6 wherein the urine deflector is integrated into bowl portion of the removable bowl and is located approximately opposite the handle portion.

8. The potty seat of claim 1 wherein the removable bowl has a forward sloping bottom.

9. The potty seat of claim 1 further comprising a non slip bottom.

10. The potty seat of claim 1 wherein the handle portion contains a handle cut out.

11. The potty seat of claim 10, wherein the handle cut out is a transport handle.

12. The potty seat of claim 3 wherein the forward sloping open seat portion of the base chair causes the user's waste to collect in the front of the removable bowl when the removable bowl is supported by the rim portion.

13. The potty seat of claim 3 further comprising a urine deflector, and wherein the forward sloping open seat portion of the base chair causes the user's urine stream to be diverted downwardly into the front of the removable bowl when the removable bowl is supported by the rim portion.

14. The potty seat of claim 1 wherein the removable bowl is ladle shaped.

15. The potty seat of claim 1 wherein the handle portion allows a user to remove the removable bowl and dispose of the waste without contacting the waste.

* * * * *